United States Patent [19]

Davis

[11] 4,168,504

[45] Sep. 18, 1979

[54] MULTIMODE DUAL FREQUENCY ANTENNA FEED HORN

[75] Inventor: Donald A. Davis, Canton, Tex.

[73] Assignee: E-Systems, Inc., Dallas, Tex.

[21] Appl. No.: 873,069

[22] Filed: Jan. 27, 1978

[51] Int. Cl.[2] ..... H01Q 13/00

[52] U.S. Cl. ..... 343/786; 343/772

[58] Field of Search ..... 343/786, 777, 776, 778, 343/858, 772, 781

[56] References Cited

U.S. PATENT DOCUMENTS

| | | | |
|---|---|---|---|
| 3,831,176 | 8/1974 | Epis et al. | 343/786 |
| 3,906,508 | 9/1975 | Foldes | 343/786 |

FOREIGN PATENT DOCUMENTS

| | | | |
|---|---|---|---|
| 1219872 | 3/1969 | United Kingdom | 343/786 |

*Primary Examiner*—David K. Moore
*Attorney, Agent, or Firm*—Robert V. Wilder

[57] ABSTRACT

A prime focus multimode feed horn is used to illuminate a parabolic reflector such that the reflector-horn combination produces improved performance in the E-plane and H-plane of a principal aperture. A feed assembly which includes the multimode horn also has a hub assembly that is incorporated into the reflector with support structure, a boom, supporting interconnecting waveguides and the multimode dual frequency horn. Directly coupling the horn to the feed assembly is an orthomode generator connected to a receive waveguide and a transmit waveguide. The orthomode generator is assembled to a horn body waveguide that supports a horn aperture having a circular configured principal aperture surrounded by radially displaced circular rings forming concentric channels for modification of the E-plane receive pattern. Assembled into the horn aperture is an insert having opposed shoulders in the H-plane and opposed steps in the E-plane such that for an incoming plane wave the first zeros of the focal plane Bessel Function Distribution are coincident with the effective horn aperture. Also extending into the principal aperture in the H-plane are opposed matching buttons.

14 Claims, 9 Drawing Figures

MULTIMODE DUAL FREQUENCY ANTENNA FEED HORN

This invention relates to a prime focus antenna feed horn for use with a parabolic reflector, and more particularly to a multimode dual frequency horn for achieving maximum on axis gain while having minimum side lobe level losses.

Satellite earth stations usually are large diameter parabolic antennas using a cassegrain feed system and ideally provide an antenna which gives a uniform signal strength over the entire coverage area. With the advent of more powerful satellite transmitters and more sensitive satellite receivers, the earth station antenna can be reduced in size and a greater use is being made of parabolic reflectors that are ten or eleven meters in diameter. The smaller antennas, however, are required to have the same transmit and receive capabilities as the larger older antennas. In addition, the smaller antenna is usually located in an area of high RF interference with the result that stringent requirements are placed on the antenna minor lobe characteristics.

In a horn-parabloid reflector antenna, the overall radiation pattern can be altered by varying the illumination of the reflector. The ideal situation from the standpoint of highest gain and narrowest beam width occurs when the signal distribution over the reflector is uniform in magnitude and phase. The illumination of the reflector is conventionally controlled by varying the dimensional parameters of the feed horn. It has been found, however, that an increase in the waveguide cross section of the feed horn is accompanied by the appearance of secondary lobes particularly in the E-plane. One cause of the secondary lobe is the presence of higher order waves which are generated at the mouth and at the throat discontinuity of the horn. In the H-plane the throat reflection is usually small in comparison with the mouth reflection and hence the horn has much lower side lobes. The problem with previous attempts to improve the efficiency of a horn-parabloid reflector antenna is the generation of the side lobes at levels that affect the on axis gain.

In a dual polarized horn, such as the present invention, two independent microwave frequency signals are utilized, with each signal polarized at 90° in space orientation to the other so as to be mutually noninterfering. Such signals may both be either transmitted or received by a multimode dual frequency horn. Such a horn may be used not only with satellite earth stations, but also in other communication systems employing simultaneous transmit and receive of dual polarization signals. Further, the same multimode approach can be used to produce a broadband feed horn for radar systems transmitting circular polarized waves, and receiving reflections therefrom. Thus, while the subject invention described herein is applicable to small satellite antennas it has broader applications such as for linearly polarized focal point feed systems which have a requirement of maximum on axis gain while having minimum side lobe levels.

In accordance with the present invention, a feed horn transmits and receives RF energy using two orthogonally polarized channels in two separate frequency bands. The orthogonal polarizations appear different in order to optimize energy gain, while minimizing side lobe levels. Either one or both of the frequency band characteristics can be independently optimized by a modification of the radiating apertures.

In construction, the feed horn of the present invention includes an orthogonal mode junction, a section of circular waveguide and the horn aperture. The improvement is found in the horn aperture which includes three concentric rings forming three concentric channels which in combination with a metallic insert modifies the E-plane receive pattern. The dimensions of the insert are such that the focal plane capture area is matched over the focal plane to the first zeros of the focal plane Bessel Function Distribution which is normally due to an incident plane wave. Additional capture area is obtained by the horn of the present invention in the receive channel E-plane by sizing the radiating aperture to just include the second zeros of that Bessel Function. Since the initial horn dimensions are approximately sized for a given reflector edge directed illumination, matching the aperture to the focal plane results in maximum gain for the particular edge illumination.

In the transmit mode for the horn of the present invention. the waveguide diameter is selected so that the H-plane transmit pattern is suitable without further modification. For the E-plane pattern a step between a circular waveguide and the horn aperture insert is configured to generate the $TE_{10}$, $TM_{21}$ and $TE_{21}$ modes of a quasi-rectangular aperture. The resultant field from combining these three modes in the aperture is concentrated at the aperture center and matches the focal plane image to produce an efficient reflector feed combination.

In accordance with the present invention, there is provided a dual polarized prime focus antenna feed horn for use with a parabolic reflector that includes a horn body waveguide with a horn aperture mounted thereto. The horn aperture includes a principal radiating aperture and also juxtapositioned channels, the latter for producing out of phase coupling to the principal aperture. Assembled to the horn aperture is an insert that modifies the E-plane pattern to maximize the focal plane capture area. The principal aperture is covered by an aperture window at the assembled insert.

A more complete understanding of the invention and its advantages will be apparent from the specification and claims and from the accompanying drawings illustrative of the invention.

Referring to the drawings.

Figure 1:
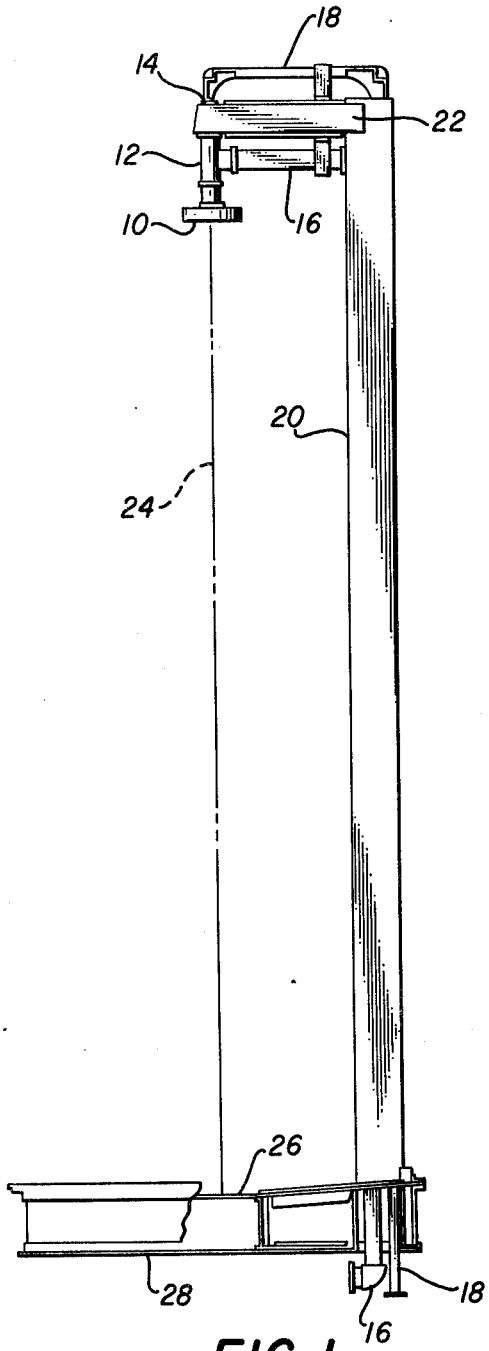
FIG. 1 is a schematic of a feed assembly for use with a parabolic reflector and including the feed horn of the present invention.

Referring to FIG. 1, a simplified schematic of a complete feed assembly is shown and includes a radome 10 encompassing a multimode dual frequency feed horn that is fastened to an orthomode junction 12 terminating at a separation point coupling 14 and coupled to a receive waveguide 16. Connected to the separation point coupling 14 is a transmit waveguide 18 that extends through a tubular support 20. Also extending through the tubular support 20 is the receive waveguide 16. Secured by welding or other fastening means to the tubular support 20 is a cantilever arm 22 for positioning the radome 10 along an axis 24 normal to a parabolic reflector (not shown) that includes a reflector surface 26 as part of the feed assembly. Also forming a part of the feed assembly is a mounting plate 28 including structure for supporting the reflector surface and tubular support 20.

Figure 2:
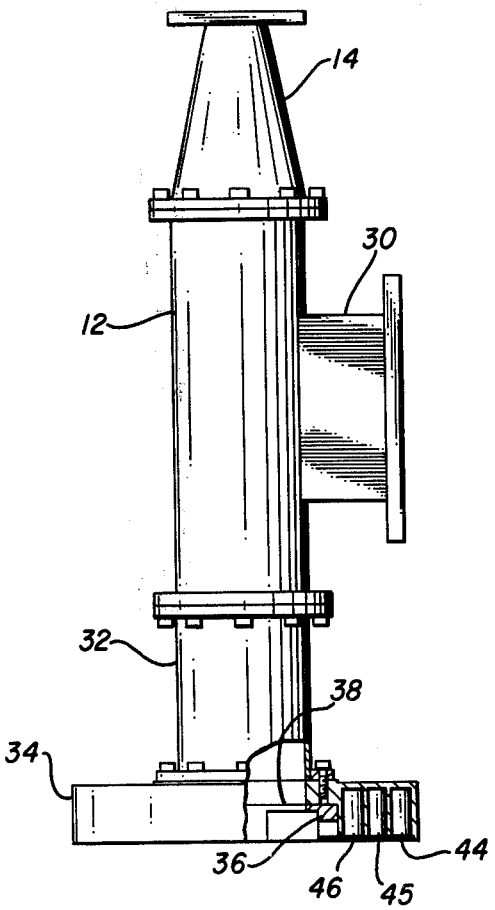
FIG. 2 is a side view, partially cut away, of the feed horn in the assembly of FIG. 1 coupled to an orthomode generator for multimode dual frequency operation.

Referring to FIG. 2, there is shown in greater detail the orthomode junction 12 including the separation point 14 and a waveguide coupler 30 for connecting to the receiver waveguide 16. Also connected to the orthomode junction 12 is a horn body waveguide 32 that is fastened to a horn aperture 34 that has assembled therein a wave modification insert 36. A window 38 encloses the opening of the waveguide 32 and typically consists of a 5 mil to 10 mil mylar sheet.

Figure 3:
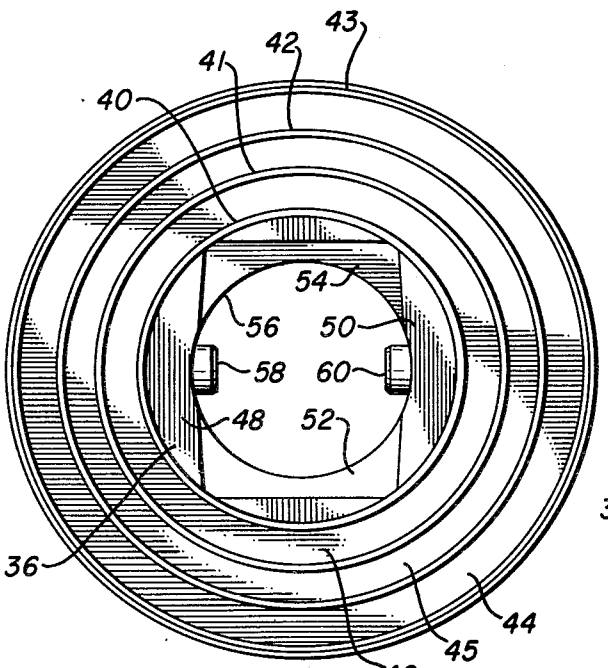
FIG. 3 is an end view of the feed horn in FIG. 2 illustrating in greater detail the three concentric channels for producing out of phase coupling to a principal aperture of the horn.

Referring to FIG. 3, there is shown an end view of the horn aperture including concentric rings 40–43 that form concentric channels 44–46 as best illustrated in FIG. 2. The wave modification insert 36 is assembled within the concentric ring 40 and forms a quasi-rectangular radiating aperture by means of opposed shoulders 48 and 50 and opposed steps 52 and 54.

Figure 4:
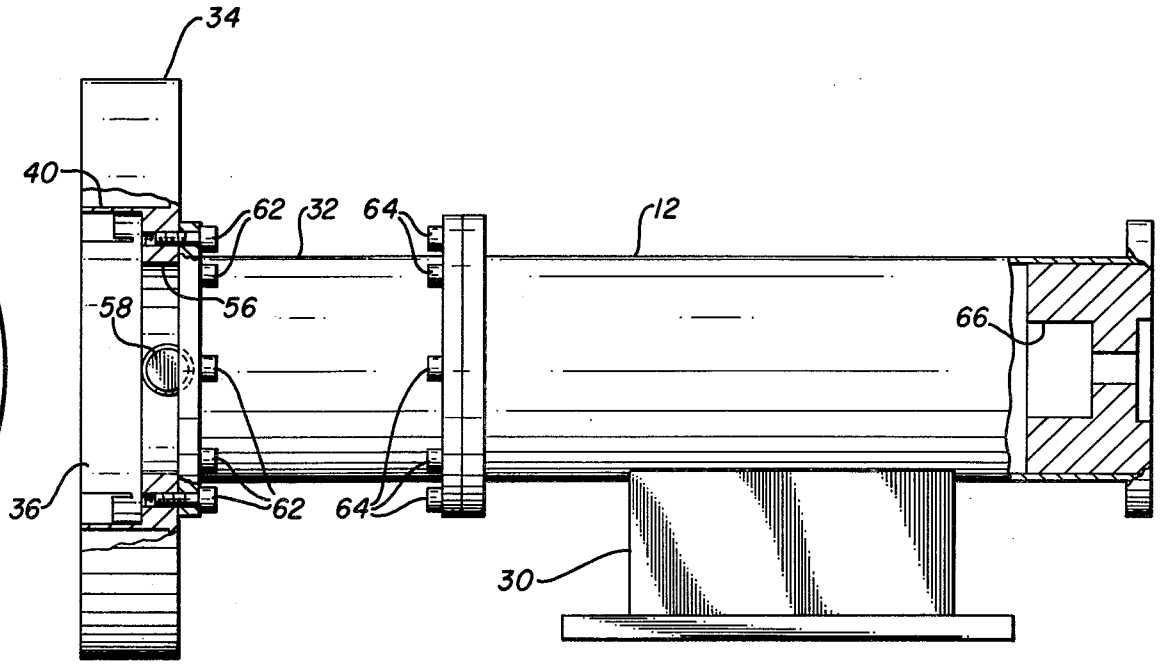
FIG. 4 is a bottom view, partially cut away, showing additional details of the feed horn of FIG. 2.

As shown in FIGS. 3 and 4, extending into the radiating aperture 56 are opposed matching buttons 58 and 60. Typically, these buttons may be attached to the inside diameter of the radiating aperture 56 by means of an adhesive or brazing.

Also shown in FIG. 4 is the horn body waveguide 32 fastened to the horn aperture 34 by means of machine screws 62. Also bolted to the horn body waveguide 32 by means of machine screws 64 is the orthomode junction 12. In accordance with conventional feed horn techniques, included within the separation point coupling 14 is a microwave transformer 66 of conventional design.

Figure 5:
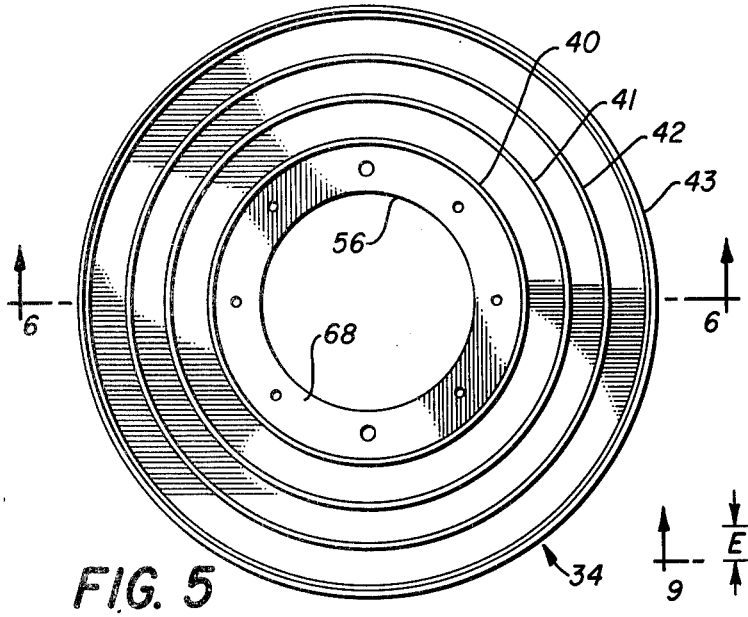
FIG. 5 is an end view of the horn aperture of the feed horn of the present invention as one element of the total assembly.
Figure 6:
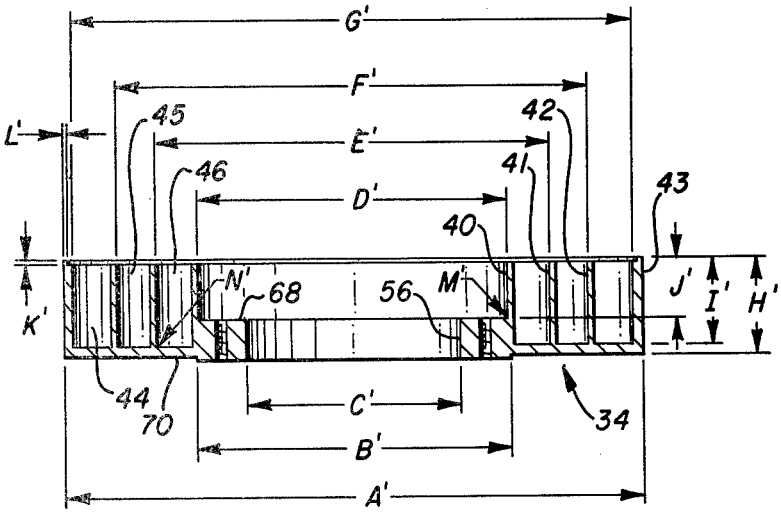
FIG. 6 is a sectional view of the horn aperture taken along the line 6—6 of FIG. 5.

Referring to FIGS. 5 and 6, there is shown an end view and a sectional view, respectively, of the horn aperture 34 including the concentric rings 40–43 and a mounting ring 68 to which is bolted the wave modification insert 36. The mounting ring 68 includes the radiating aperture 56. As best shown in FIG. 6, each of the concentric channels 44–46 is formed between adjacent concentric rings and a bottom plate 70. The bottom plate 70 is in the form of a disc-shaped member extending from the outer diameter of the mounting flange 68 to the outside concentric ring 43.

Walls of the adjacent concentric rings and the bottom plate 70 form concentric channels having a depth selected to produce out of phase coupling to the principal radiating aperture 56. By constructing the horn aperture 34 with multiple concentric channels the number of higher order waveguide modes excited in the channels is minimized. Boundary conditions in the principal radiating aperture 56 allow only a single TE waveguide mode to excite the modified circular waveguides consisting of the concentric channels 44–46.

In one embodiment of the invention for a transmit frequency of 5.925 GHz to 6.425 GHz at a receive frequency from 3.7 GHz–4.2 GHz the horn aperture 34 was constructed by machining brass stock to the dimensions given in Table 1 below.

TABLE 1

| DIMENSION | INCHES |
|---|---|
| A' | 6.00 |
| B' | 3.25 |
| C' | 2.215 |
| D' | 3.240 |
| E' | 4.120 |
| F' | 4.900 |
| G' | 5.800 |
| H' | 1.000 |
| I' | 3.70 |
| J' | .600 |
| K' | .020 |
| L' | .050 |
| M' | .02 |
| N' | .06 |

Figure 7:
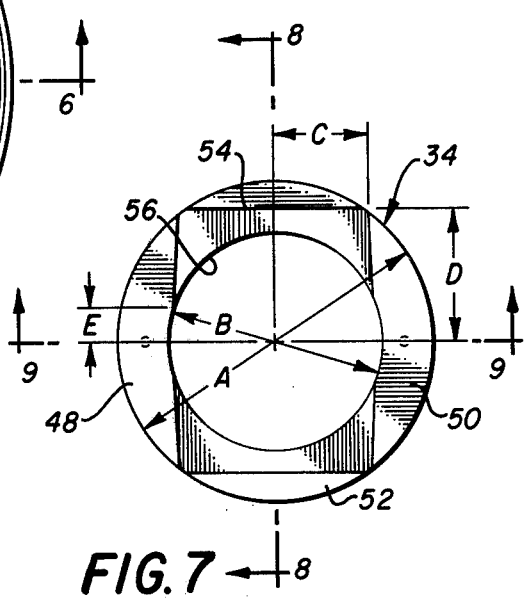
FIG. 7 is an end view of an insert for the horn aperture of FIG. 5 for maximizing the focal plane capture area in the E-plane and H-plane.
Figure 8:
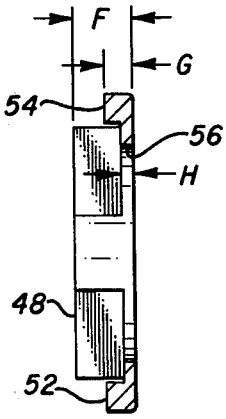
FIG. 8 is a sectional view of the insert of FIG. 7 taken along the line 8—8.
Figure 9:
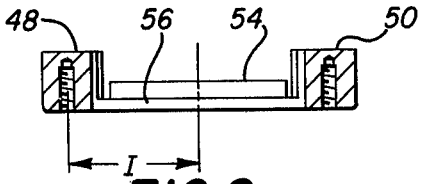
FIG. 9 is a sectional view of the insert of FIG. 7 taken along the line 9—9.

Referring to FIGS. 7–9, there is shown in detail the wave modification insert 36 including the opposed shoulders 48 and 50 and the opposed steps 52 and 54. The dimensions of the insert, as given in Table 2 below, for the same frequency as given above for the horn aperture 34, are such that the focal plane capture area is maximized in the E-plane and H-plane for the first zeros of the focal plane Bessel Function Distribution which would be due to an incident plane wave. Additional capture areas are obtained in the receive channel E-plane by sizing the principal radiating aperture 56 to just include the second zeros of the Bessel Function. Since the initial horn dimensions of the horn body waveguide 32 are approximately sized for a given reflector edge directed illumination, matching the wave modification insert 36 to the focal plane image results in maximum gain for a particular edge illumination.

TABLE 2

| DIMENSION | INCHES |
|---|---|
| A | 3.240 |
| B | 2.215 |
| C | .970 |
| D | 1.335 |
| E | .375 |
| F | .600 |
| G | .287 |
| H | .100 |
| I | 1.350 |

With the horn of the present invention operating in a transmit mode more than one mode exists in the principal radiating aperture 56. As most clearly shown in FIG. 3, the principal radiating aperture 56 is larger in the E-plane than in the H-plane. The diameter of the horn body waveguide 32 is selected so that the H-plane transmit pattern is suitable without additional modification. The shoulders 48 and 50 are designed to extend the diameter of the horn body waveguide 32 to the transmit plane of the horn aperture 34. The dimension "B" is thus the same as the diameter of the horn body waveguide 32.

With reference to the E-plane aperture, the steps 52 and 54 between the horn body waveguide 32 and the inside diameter of the concentric ring 40 generates the $TE_{10}$, $TM_{21}$ and $TE_{21}$ modes in the quasi-rectangular aperture formed by the steps and the inside dimension of the shoulders 48 and 50. Since these modes are generated so close to the principal radiating aperture 56 the relative phases enforced by the boundary conditions at the steps 52 and 54 virtually exist at the principal radiating aperture. Control of the relative amplitude of the $TE_{10}$ mode and higher order modes is a function of the initial step size. Small changes in relative amplitude are accomplished by modifying the size of the steps 52 and 54. The effect of the wave modification insert 36 is to combine the $TE_{10}$, $TM_{21}$ and $TE_{21}$ modes in the aperture 56 to produce an E-field which is tapered rather than uniform. This resultant field, concentrated in the center of the aperture, matches the focal plane image to produce an efficient reflector feed combination.

Throughout the specification terms such as "feed", "illumination", "reflect", etc may have apparent implification as to either a transmit or receive antenna. However, it should be understood that the terms refer to the reciprocal function in that the feed horn of the present invention, as explained previously, operates as both a transmit and receive element.

While only one embodiment of the invention, together with modifications thereof, has been described in detail herein and shown in the accompanying drawings, it will be evident that various further modifications are possible without departing from the scope of the invention.

What is claimed is:

1. A dual polarized multimode feed horn for use with a parabolic reflector, comprising in combination:

a horn body waveguide, a horn aperture mounted to said horn body and having a principal aperture, said horn aperture including juxtapositioned concentric channels for producing out of phase coupling with the principal aperture, a quasi-rectangular radiating aperture insert mounted to said horn aperture in the innermost concentric channel to modify the E-plane pattern to maximize the focal plane capture area, and an aperture window covering the principal aperture at the assembled insert.

2. A dual polarized multimode feed horn as set forth in claim 1 wherein said horn aperture includes three juxtapositioned concentric channels to minimize the excitation of undesired higher order waveguide modes.

3. A dual polarized multimode feed horn as set forth in claim 1 wherein said insert includes opposed shoulders for defining the H-plane transmit pattern.

4. A dual polarized multimode feed horn as set forth in claim 1 wherein said insert includes opposed steps for generating modes in the E-plane of the principal aperture to match the focal plane image thereby improving the efficiency of the reflector-feed combination.

5. A dual polarized multimode feed horn as set forth in claim 1 wherein said insert includes opposed shoulders for defining the H-plane transmit pattern, and opposed steps on an orthogonal axis to the opposed shoulders for generating modes in the E-plane of the principal aperture to match the focal point image thereby improving the efficiency of the reflector-feed combination.

6. A dual polarized multimode feed horn as set forth in claim 5 wherein said opposed shoulders and opposed steps define a quasi-rectangular principal aperture having a dimension in the H-plane substantially the same as a dimension of said horn body waveguide.

7. A dual polarized multimode feed horn as set forth in claim 1 wherein said insert includes opposed matching buttons extending inwardly in the H-plane of the principal aperture.

8. A dual polarized multimode feed horn for use with a parabolic reflector, comprising in combination:

a cylindrical horn body waveguide, a circular horn aperture mounted to said horn body and having a circular principal aperture, said horn aperture further including concentric channels extending outwardly from the center thereof and for producing out of phase coupling to the principal aperture, a circular insert assembled to said horn aperture to modify the E-plane pattern and maximize the focal plane capture area, and an aperture window covering the principal aperture at said insert and the horn aperture.

9. A dual polarized multimode feed horn as set forth in claim 8 wherein said insert includes means for modifying the principal aperture to have a quasi-rectangular configuration.

10. A dual polarized multimode feed horn as set forth in claim 8 wherein said concentric channels are spaced to minimize the number of excited higher order waveguide modes.

11. A dual polarized multimode feed horn as set forth in claim 10 including concentric rings for defining said concentric channels.

12. A dual polarized multimode feed horn as set forth in claim 8 wherein said insert includes opposed shoulders for defining the H-plane transmit pattern, and opposed steps for generating modes in the E-plane of the principal aperture to match the focal plane image thereby improving the efficiency of the reflector-feed combination.

13. A dual polarized multimode feed horn as set forth in claim 12 wherein the steps are sized to control the relative amplitude of the $TE_{10}$ and higher order modes.

14. A dual polarized multimode feed horn as set forth in claim 8 wherein said insert includes opposed matching buttons extending inwardly into the principal aperture in the H-plane.

* * * * *